US010297921B2

(12) United States Patent
Hill et al.

(10) Patent No.: US 10,297,921 B2
(45) Date of Patent: May 21, 2019

(54) DIPOLE ANTENNA WITH CAVITY

(71) Applicant: SPEED WIRELESS TECHNOLOGY INC., San Jose, CA (US)

(72) Inventors: Robert Hill, Medford, OR (US); Che Ting Kuo, San Jose, CA (US); Bin Yu, San Jose, CA (US)

(73) Assignee: SPEEDLINK TECHNOLOGY INC., Cupertino, CA (US)

( * ) Notice: Subject to any disclaimer, the term of this patent is extended or adjusted under 35 U.S.C. 154(b) by 47 days.

(21) Appl. No.: 15/455,663

(22) Filed: Mar. 10, 2017

(65) Prior Publication Data

US 2018/0261906 A1 Sep. 13, 2018

(51) Int. Cl.
*H01Q 9/26* (2006.01)
*H01Q 19/10* (2006.01)

(52) U.S. Cl.
CPC ..... *H01Q 19/108* (2013.01); *H01Q 9/26* (2013.01); *H01Q 9/265* (2013.01)

(58) Field of Classification Search
CPC ..... H01Q 9/26; H01Q 9/265; H01Q 9/28; H01Q 9/285; H01Q 19/108
See application file for complete search history.

(56) References Cited

U.S. PATENT DOCUMENTS

2011/0234467 A1* 9/2011 Huang ..... H01Q 1/38 343/837
2012/0229343 A1* 9/2012 Sudo ..... H01Q 1/38 343/700 MS
2018/0013205 A1* 1/2018 Rosenauer ..... H01Q 15/16

* cited by examiner

*Primary Examiner* — Robert Karacsony
(74) *Attorney, Agent, or Firm* — Womble Bond Dickinson (US) LLP

(57) ABSTRACT

A dipole antenna with resonant cavities operates with a resonant frequency near the antenna operating frequency to widen the operating bandwidth of the dipole antenna. Specifically, a ground consisting of multiple layers of electrically conductive planes and electrically conductive vias connecting the electrically conductive planes to form a ground wall cavity for a dipole member. The ground wall induces multiple resonant frequencies due to its coupling effect to the dipole member. A radio frequency (RF) frontend for mobile communication devices contains the dipole antenna with cavity coupled to a transceiver to receive and transmit communication signals.

22 Claims, 5 Drawing Sheets

DIPOLE ANTENNA WITH CAVITY

TECHNICAL FIELD

This disclosure relates generally to antennas, and in particular to dipole antennas with a cavity.

BACKGROUND

Mobile devices, such as mobile phones, are becoming increasingly popular. Such devices are often provided with wireless communications capabilities. In wireless communications, dipole antennas are well-known and have been used in various applications, such as "rabbit ears" in television set; in FM radio broadcast receivers, and in radar and military, etc.

For the forthcoming fifth generation (5G) cellular standard, millimeter wave antennas are a potential solution. Moreover, as the demand for a higher bandwidth increases, the 3GPP and other standing committees will undoubtedly establish a fifth generation mobile communications standard in an operating frequency range higher than the current third and fourth generation wireless standards. In the potential millimeter wave operating frequencies, antennas can be fabricated on-chip or on-package to reduce overhead costs. Dipole antenna is a strong candidate for millimeter wave on-chip/on-package antennas. Although dipole antenna is suitable in millimeter wave antenna designs, it suffers from a narrow bandwidth and is less adequate for wide bandwidth applications.

BRIEF DESCRIPTION OF THE DRAWINGS

The present invention is illustrated by way of example and not limitation in the figures of the accompanying drawings in which like references indicate similar elements

DETAILED DESCRIPTION

Various embodiments and aspects will be described with reference to details discussed below, and the accompanying drawings will illustrate the various embodiments. The following description and drawings are illustrative and are not to be construed as limiting. Numerous specific details are described to provide a thorough understanding of various embodiments. However, in certain instances, well-known or conventional details are not described in order to provide a concise discussion of embodiments.

Reference in the specification to "one embodiment" or "an embodiment" means that a particular feature, structure, or characteristic described in conjunction with the embodiment can be included in at least one embodiment. The appearances of the phrase "in one embodiment" in various places in the specification do not necessarily all refer to the same embodiment. The processes depicted in the figures that follow are performed by processing logic that comprises hardware (e.g. circuitry, dedicated logic, etc.), software, or a combination of both. Although the processes are described below in terms of some sequential operations, it should be appreciated that some of the operations described may be performed in a different order. Moreover, some operations may be performed in parallel rather than sequentially.

Embodiments of the invention relate to a dipole antenna with cavity for mobile communication devices. In one embodiment, a dipole antenna contains a dipole member and a resonator structure. The resonator structure contains a cavity (e.g., a relatively rectangular cavity) that has planar dimensions greater than the dipole member planar dimensions. The dipole member is positioned in the cavity (also referred to as a planar resonant cavity). The resonator structure includes as least two electrically conductive planes, and an array of electrically conductive vias connecting the two electrically conductive planes to form a resonant cavity. The dipole antenna may be embedded within a radio frequency (RF) frontend for a mobile communication device, which may include a transceiver to transmit and receive communication signals.

A dipole antenna is an antenna consisting of two bilaterally symmetrical electrically conductive elements such as metal wires or rods. The most common dipole antenna is a half-wave dipole antenna, in which each of the two rod elements is approximately ¼ wavelengths long. The two elements radiate equal power in all azimuthal direction perpendicular to the axis of the antenna. Several variations of the half-wave dipole antenna are used for various wireless applications, such as the folded dipole, short dipole, cage dipole, bow-tie, and batwing dipole antennas. A folded dipole antenna is a dipole antenna with the two elements' ends folded back around and connected to each other, forming a loop.

Figure 1:
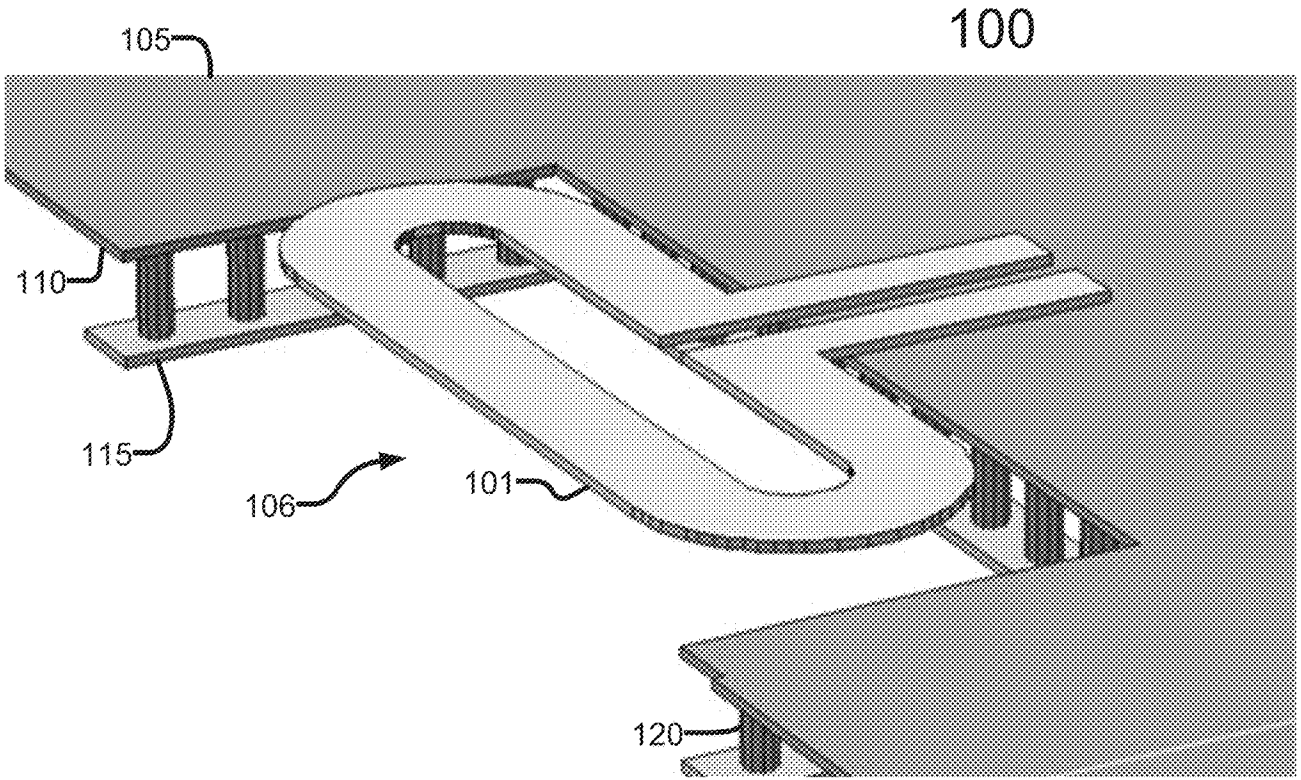
FIG. 1 illustrates a perspective view of a dipole antenna in accordance with an embodiment of the disclosure.

FIG. 1 illustrates a perspective view of a dipole antenna according to one embodiment of the invention. Dipole antenna 100 includes a dipole member 101 and a resonator structure 105, in accordance with an embodiment of the disclosure. The resonator structure 105 includes a first electrically conductive plane 110, a second electrically conductive plane 115, and an array of electrically conductive vias 120 disposed between and coupled to the first electrically conductive plane 110 and the second electrically conductive plane 115 to form a resonant cavity 106, in accordance with an embodiment. The electrically conductive material can be any kind of electrically conductive material such as metal (e.g., copper, platinum, silver, etc.).

In this embodiment, conductive plane 110 has a substantially large conductive surface or plane area. Conductive plane 115 is in an elongate strip shape. Conductive plane 110 includes a cut-out or opening on an edge to form a U-shape cut-out or opening. Similarly, conductive plane 115 is formed in a U-shape strip aligned with the edges of the U-shape cut-out of conductive plane 110.

The array of vias 120 is disposed along the edges of the U-shape cut-out, connecting conductive plane 110 and conductive strip 115 to form cavity 106. The plane surfaces of conductive plane 110 and conductive strip 115 are substantially in parallel.

Dipole member 101 is positioned within the U-shape cut-out without electrically contacting conductive planes 110 and 115. The size of the U-shape cut-out may vary dependent upon the size of the dipole member 101. Although dipole member 101 is a folded dipole member, other shapes of dipole members can also be applied here.

Using plane 110 with larger area or surface operating as a resonating element may help the antenna to exhibit a larger bandwidth than a dipole antenna based on antenna resonating elements formed from wires or narrow strips. This may allow the antenna to server as a broadband antenna.

Figure 2:
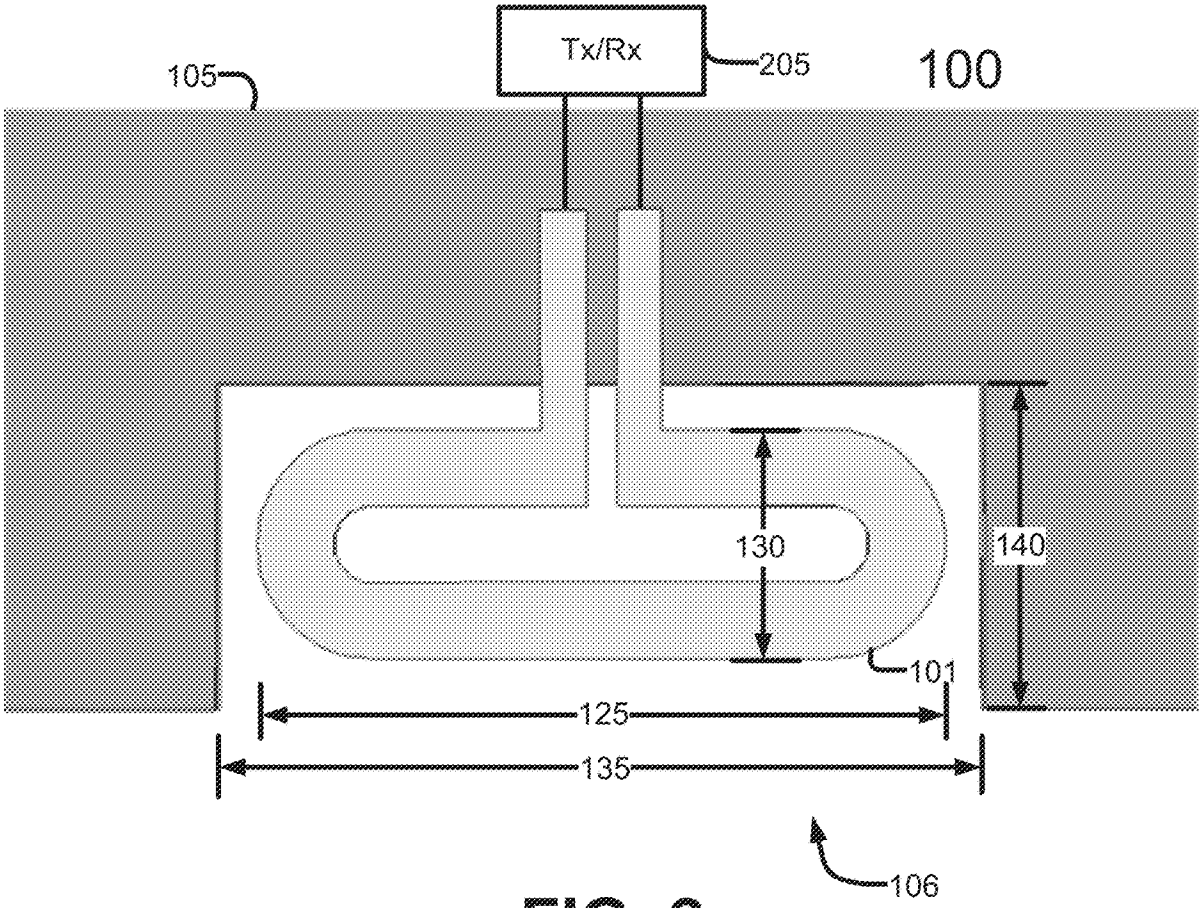
FIG. 2 illustrates a top view of a dipole antenna in accordance with an embodiment of the disclosure.

FIG. 2 illustrates a top view of the dipole antenna 100. In one embodiment, the dipole member 101 may be a folded dipole or an open dipole, or any other shapes of dipole members. In another embodiment, the dipole member 101 includes a planar dipole length 125 of approximately lambda/2 (λ/2) and a planar dipole width 130 of approximately λ/4. Lambda λ represents a wavelength associated with the dipole antenna's operating frequency.

In one embodiment, the resonant structure 105 forms a resonant cavity 106 having a planar cavity length 135 of approximately λ/1.7 and a planar cavity width 140 of approximately λ/3.5. Note that in this example, the cavity is in a relatively rectangular shape. However, other shapes such as circle, oval, square may also be applied.

In one embodiment, the dipole member 101 is situated within the resonant cavity 106 to induce a resonant frequency. In a particular embodiment, dipole member 101 is positioned substantially centrally within resonant cavity 106. The dipole member 101 is not in electrical contact with the first electrically conductive plane 110 and the second electrically conductive plane 115. In an alternate embodiment, the first electrically conductive plane 110 and the second electrically conductive plane 115 are coupled to an electrical ground.

In another embodiment, the dipole antenna 100 further includes a dielectric material filled within the spacing between the dipole member 101, the first electrically conductive plane 110 and the second electrically conductive plane 115. The dielectric material can be a variety of materials such as epoxy. In various embodiments, the dipole member 101, the first electrically conductive plane 110, the second electrically conductive plane 115, and the vias 120 may be made of a material of high electrical conductivity, such as gold, silver, platinum, copper, etc.

Figure 3:
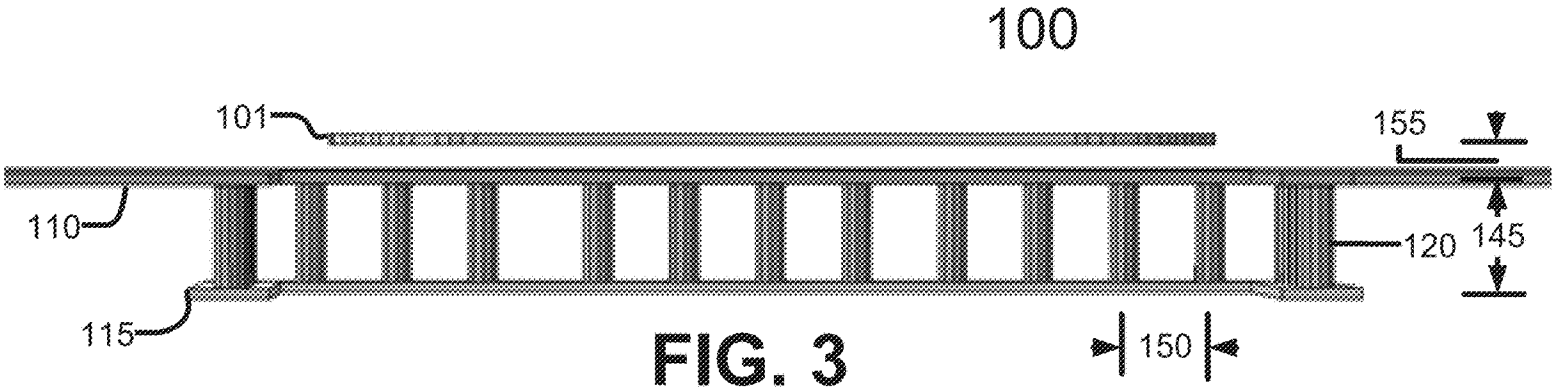
FIG. 3 illustrates a front view of a dipole antenna in accordance with an embodiment of the disclosure.

FIG. 3 illustrates a front view of a dipole antenna according to one embodiment of the invention. Folded dipole antenna 100 includes a resonator structure 105 that includes a first electrically conductive plane 110, a second electrically conductive plane 115, and an array of electrically conductive vias 120 disposed between and coupled to the first electrically conductive plane 110 and the second electrically conductive plane 115, in accordance with an embodiment. In another embodiment, the first electrically conductive plane 110 is positioned substantially parallel with the second electrically conductive plane 115.

Figure 4:
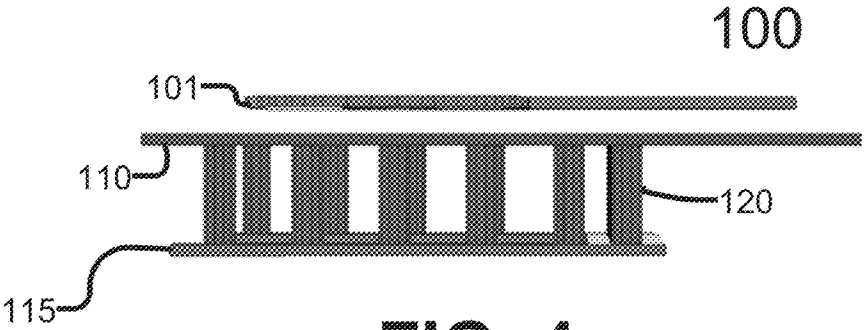
FIG. 4 illustrates a side view of a dipole antenna in accordance with an embodiment of the disclosure.

In one embodiment, the distance 145 between the first electrically conductive plane 110 and the second electrically conductive plane 115 is approximately λ/40. The distance 150 between adjacent electrically conductive vias 120 is approximately λ/30. The distance 155 between the planar dipole member 101 and the first electrically conductive plane 110 is approximately λ/100. The space between dipole member 101, plane 110 and plane 115 may be filled with a dielectric material having a low electrical conductivity, such as ceramic, silicon dielectrics, etc. FIG. 4 shows a side view of the dipole antenna.

Figure 5:
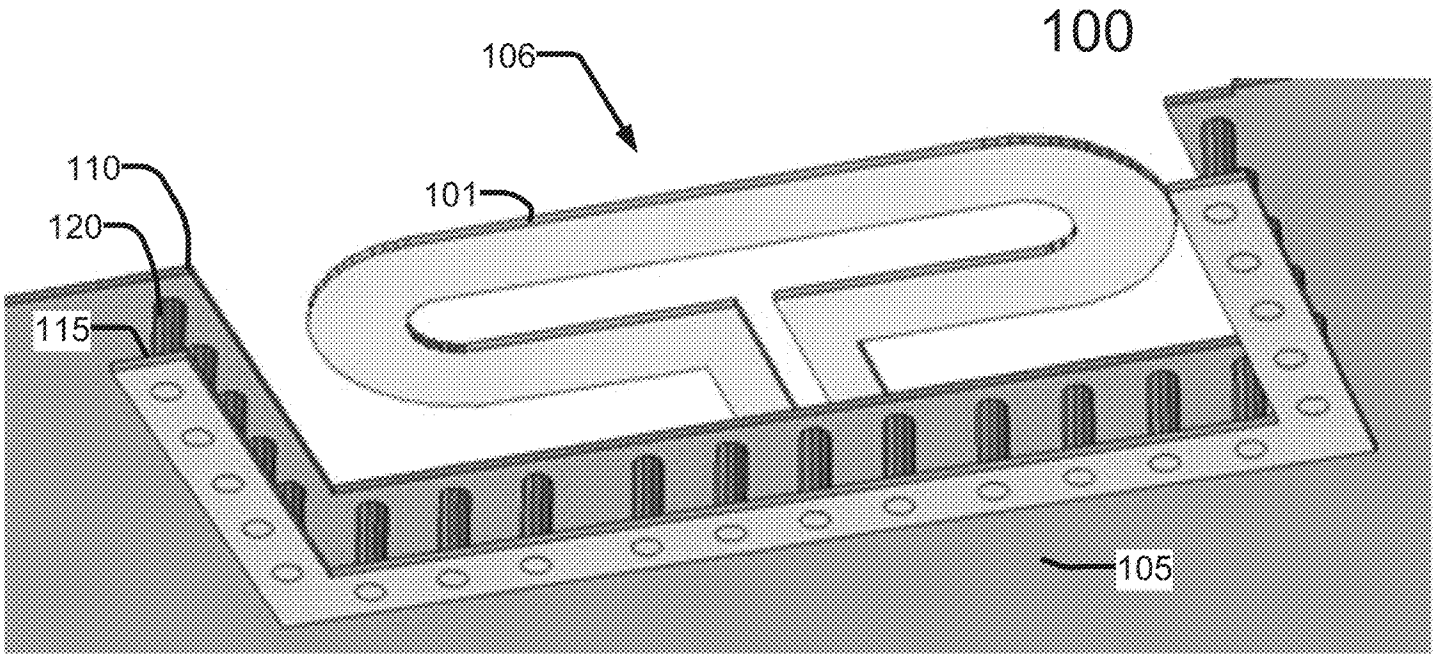
FIG. 5 illustrates a different perspective view of a dipole antenna in accordance with an embodiment of the disclosure.

FIG. 5 illustrates a second perspective view of the dipole antenna 100. In this embodiment, the dipole member 101 is substantially centrally located in the planar rectangular cavity 106 while the dipole member 101 is not electrically connected to the first electrically conductive plane 110 and the second electrically conductive plane 115. In another embodiment, the second electrically conductive plane 115 is an elongate strip. The width of the elongate strip 115 is approximately λ/40. In an alternate embodiment, the second electrically conductive plane 115 is an elongated strip forming a U-shape along an edge of the rectangular cavity 106.

Figure 6:
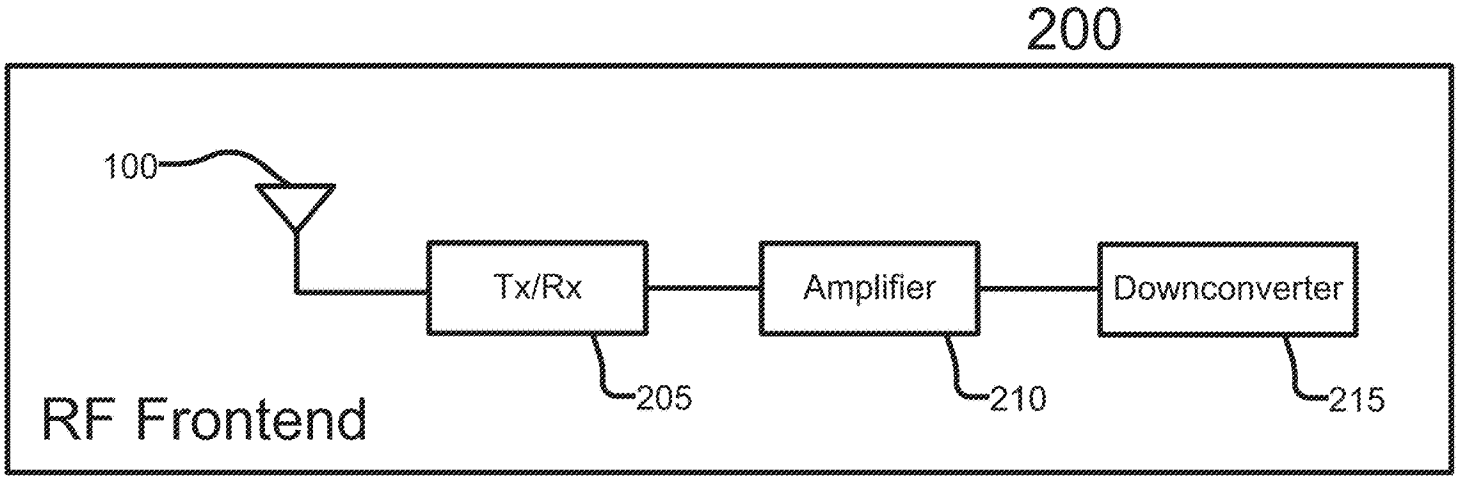
FIG. 6 illustrates a block diagram of a radio frequency (RF) frontend in accordance with an embodiment of the disclosure.

FIG. 6 is a block diagram of a radio frequency (RF) frontend integrated package or circuit according to one embodiment of the invention. RF frontend integrated package 200 includes dipole antenna 100 and a transceiver 205 coupled to the dipole antenna 100 to transmit and receive RF signals, in accordance with an embodiment. The RF frontend 200 may further include an amplifier 210 or downconverter 215. Downconverter 215 down converts RF signal from a radio frequency to a baseband frequency. The baseband frequency signals are then processed by a baseband processor (not shown). RF frontend integrated circuit 200 can be utilized in any mobile device such as a Smartphone. In such a Smartphone configuration, in addition to the wireless signal processing elements (e.g., RF frontend, baseband processor), it further includes a general-purpose processor (e.g., central processing unit or CPU), a memory, and a persistent storage device (e.g., hard disks). An operating system can be loaded in the memory and executed by the general-purpose processor. The operating system hosts a variety of mobile applications, which may be installed in the persistent storage device, loaded into the memory, and executed by the general-purpose processor.

Embodiments of the present invention are not limited to any particular application. It can be used in various wireless applications and at various frequencies and with different multiple access methods, advantageously at radio frequencies such as the fifth generation mobile communications standard frequencies.

In the foregoing specification, specific exemplary embodiments have been described. It will be evident that various modifications may be made to those embodiments without departing from the broader spirit and scope set forth in the following claims. The specification and drawings are, accordingly, to be regarded in an illustrative sense rather than a restrictive sense.

What is claimed is:

1. A dipole antenna for mobile devices, comprising:

a resonator structure comprising:

a first electrically conductive plane;

a second electrically conductive plane;

an array of electrically conductive vias disposed between and coupled to the first electrically conductive plane and the second electrically conductive plane to form a resonant cavity; and a dipole member disposed adjacent to the resonant cavity of the resonator structure to induce at least a first resonant frequency associated with the dipole member, wherein the dipole members is raised a predetermined distance above the resonator structure based on λ, wherein λ is a wavelength associated with the dipole antenna's operating frequency.

2. The dipole antenna of claim 1, wherein the dipole member comprises one of an open dipole antenna and a folded dipole antenna.

3. The dipole antenna of claim 2, wherein the folded dipole antenna has a planar length of approximately λ/2 and width of approximately λ/4 dimensions.

4. The dipole antenna of claim 1, wherein the first and second electrically conductive planes each includes a cut-out to form a rectangular resonant cavity with a planar dimension of length of approximately λ/1.7 and width of approximately λ/3.5.

5. The dipole antenna of claim 4, wherein the array of electrically conductive vias are situated along edges of the rectangular resonant cavity, wherein the dipole member is situated substantially centrally to the rectangular resonant cavity to induce the first resonant frequency associated with the dipole member.

6. The dipole antenna of claim 1, wherein the first electrically conductive plane is positioned substantially parallel with the second electrically conductive plane.

7. The dipole antenna of claim 1, wherein the first electrically conductive plane and the second electrically conductive plane are coupled to an electrical ground.

8. The dipole antenna of claim 1, wherein the second electrically conductive plane comprises an elongated strip coupled to the array of electrically conductive vias disposed thereon.

9. The dipole antenna of claim 8, wherein the elongated strip is formed in a U-shaped strip along an edge of the resonant cavity.

10. The dipole antenna of claim 1, wherein the dipole member is not in electrical contact with the first and second electrically conductive planes.

11. The dipole antenna of claim 1, further comprising a dielectric material filled within a space between the dipole member, the first electrically conductive plane and the second electrically conductive plane.

12. A radio frequency (RF) frontend chip for mobile devices, comprising:

a dipole antenna; and a transceiver coupled to the dipole antenna to transmit and receive RF signals through the dipole antenna, wherein the dipole antenna comprises:

a resonator structure comprising:

a first electrically conductive plane, a second electrically conductive plane, an array of electrically conductive vias disposed between and coupled to the first electrically conductive plane and the second electrically conductive plane to form a resonant cavity, and a dipole member disposed adjacent to the resonant cavity of the resonator structure to induce at least a first resonant frequency associated with the dipole member, wherein the dipole member is raised a predetermined distance above the resonator structure based on λ, wherein λ is a wavelength associated with the dipole antenna's operating frequency.

13. The radio frequency (RF) frontend chip of claim 12, wherein the dipole member comprises one of an open dipole antenna and a folded dipole antenna.

14. The radio frequency (RF) frontend chip of claim 13, wherein the folded dipole antenna has a planar length of approximately λ/2 and width of approximately λ/4 dimensions.

15. The radio frequency (RF) frontend chip of claim 12, wherein the first and second electrically conductive planes each includes a cut-out to form a rectangular resonant cavity with a planar dimension of length of approximately λ/1.7 and width of approximately λ/3.5.

16. The radio frequency (RF) frontend chip of claim 15, wherein the array of electrically conductive vias are situated along edges of the rectangular resonant cavity, wherein the dipole member is situated substantially centrally to the rectangular resonant cavity to induce the first resonant frequency associated with the dipole member.

17. The radio frequency (RF) frontend chip of claim 12, wherein the first electrically conductive plane is positioned substantially parallel with the second electrically conductive plane.

18. The radio frequency (RF) frontend chip of claim 12, wherein the first electrically conductive plane and the second electrically conductive plane are coupled to an electrical ground.

19. The radio frequency (RF) frontend chip of claim 12, wherein the second electrically conductive plane comprises an elongated strip coupled to the array of electrically conductive vias disposed thereon.

20. The radio frequency (RF) frontend chip of claim 19, wherein the elongated strip is formed in a U-shaped strip along an edge of the resonant cavity.

21. The radio frequency (RF) frontend chip of claim 12, wherein the dipole member is not in electrical contact with the first and second electrically conductive planes.

22. The radio frequency (RF) frontend chip of claim 12, further comprising a dielectric material filled within a space between the dipole member, the first electrically conductive plane and the second electrically conductive plane.

* * * * *